US011732519B2

(12) United States Patent
Pincher

(10) Patent No.: US 11,732,519 B2
(45) Date of Patent: Aug. 22, 2023

(54) SAFETY DEVICE FOR A MOVABLE BARRIER SYSTEM

(71) Applicant: ANSA Door Systems LTD, Wordsley (GB)

(72) Inventor: Steven Pincher, Wordsley (GB)

(73) Assignee: ANSA Door Systems LTD, Wordsley (GB)

( * ) Notice: Subject to any disclaimer, the term of this patent is extended or adjusted under 35 U.S.C. 154(b) by 116 days.

(21) Appl. No.: 16/980,575

(22) PCT Filed: Mar. 12, 2019

(86) PCT No.: PCT/GB2019/050695
§ 371 (c)(1),
(2) Date: Sep. 14, 2020

(87) PCT Pub. No.: WO2019/175573
PCT Pub. Date: Sep. 19, 2019

(65) Prior Publication Data

US 2021/0363806 A1 Nov. 25, 2021

(30) Foreign Application Priority Data

Mar. 12, 2018 (GB) ..... 1803931

(51) Int. Cl.
*E06B 9/68* (2006.01)
*E05F 15/40* (2015.01)
*E05F 15/665* (2015.01)

(52) U.S. Cl.
CPC ..... *E05F 15/40* (2015.01); *E06B 9/68* (2013.01); *E05F 15/665* (2015.01);
(Continued)

(58) Field of Classification Search
CPC ..... E06B 2009/6836; E06B 2009/6845; E06B 9/80; E06B 9/68; E06B 2009/6818;
(Continued)

(56) References Cited

U.S. PATENT DOCUMENTS 4,888,531 A * 12/1989 Hormann ..... E05F 15/668 318/467
5,428,923 A * 7/1995 Waggamon ..... E05F 15/43 340/650

(Continued)

FOREIGN PATENT DOCUMENTS

CN 205000801 U 1/2016
DE 3806733 A1 9/1989

(Continued)

OTHER PUBLICATIONS

International Search Report and Written Opinion issued in PCT Application Serial No. PCT/GB2019/050695 dated Sep. 19, 2019, 12 pages.

*Primary Examiner* — Abe Massad
*Assistant Examiner* — Matthew R. Shepherd
(74) *Attorney, Agent, or Firm* — Brian J. Colandreo; Jeffery T. Placker; Holland & Knight LLP

(57) ABSTRACT

A safety device (200) is provided for a movable barrier system ((100). The safety device comprises a position sensor (210) mountable, in use, to or adjacent a barrier (110). A target (220) is mountable to the other of the barrier, such that movement of the barrier causes relative movement between the position sensor and the target. A controller (240) can communicate with the position sensor. The position sensor can detect movement of the target relative to the position sensor and output a signal to the controller. The controller can receive the output signal from the position sensor, determine one or more signal characteristics from the output signal, and compare the one or more determined signal
(Continued)

characteristics with one or more predetermined signal characteristics to determine if the relative movement between the target and the position sensor is within a predefined range. A movement detection method is also provided.

15 Claims, 6 Drawing Sheets

(52) U.S. Cl.
CPC ..... *E05Y 2201/46* (2013.01); *E05Y 2400/32* (2013.01); *E05Y 2400/36* (2013.01); *E05Y 2400/44* (2013.01); *E05Y 2400/532* (2013.01); *E05Y 2400/56* (2013.01); *E05Y 2900/106* (2013.01); *E06B 2009/6836* (2013.01); *E06B 2009/6845* (2013.01)

(58) Field of Classification Search
CPC .. E06B 2009/6809; E05F 15/40; E05F 15/42; E05F 15/43; E05F 2015/434; E05F 2015/435; E05F 2015/437; E05F 15/73; E05F 15/74; E05F 15/76; E05F 2015/765; E05Y 2400/32; E05Y 2400/36; E05Y 2400/40; E05Y 2400/44; E05Y 2400/334–342; H02M 1/009
See application file for complete search history.

(56) References Cited

U.S. PATENT DOCUMENTS

| | | | | |
|---|---|---|---|---|
| 5,540,269 | A | 7/1996 | Plumer | |
| 5,689,236 | A * | 11/1997 | Kister | G08B 13/08 340/552 |
| 5,777,552 | A * | 7/1998 | Fischette | H01H 36/0046 335/206 |
| 6,070,361 | A * | 6/2000 | Paterno | G08B 13/08 49/14 |
| 6,897,630 | B2 * | 5/2005 | Murray | E05F 15/41 318/434 |
| 2003/0076060 | A1 * | 4/2003 | Colosky | H02P 6/20 318/400.32 |
| 2007/0000622 | A1 | 1/2007 | Reed et al. | |
| 2011/0049339 | A1 * | 3/2011 | Leeser | E05F 15/43 250/221 |
| 2014/0110064 | A1 | 4/2014 | Eggert et al. | |
| 2017/0122030 | A1 * | 5/2017 | Zhang | E06B 9/582 |

FOREIGN PATENT DOCUMENTS

| | | | |
|---|---|---|---|
| WO | 2014/066158 | A1 | 5/2014 |
| WO | 2019175573 | A1 | 9/2019 |

* cited by examiner

SAFETY DEVICE FOR A MOVABLE BARRIER SYSTEM

CROSS-REFERENCE TO RELATED APPLICATIONS

The subject application is a U.S. National Stage application of International Application No. PCT/GB2019/050695, filed on 12 Mar. 2019, which claims the priority of Great Britain Patent Application No. 1803931.3, filed on 12 Mar. 2018. The contents of all applications are herein incorporated by reference in their entirety.

TECHNICAL FIELD

This invention relates generally to a safety device for a movable barrier. Particularly, but not exclusively, the invention relates to a device for detecting and controlling movement of the movable barrier. The invention also relates to a method of doing the same.

BACKGROUND TO THE INVENTION

Movable barriers, such as flexible roller doors and shutters typically comprise various types of position sensors for use in controlling the barrier movement and detecting when a fully open or closed position is reached. Various types of position sensors can be used for this purpose, including mechanical limit switches, optical sensors, magnetic sensors and electrical devices such as potentiometers. In addition to simply automating the opening and closing operation of a power operated door, user safety is of paramount importance. Power operated doors must comply with certain safety regulations to prevent the door squashing, trapping, collapsing and/or otherwise injuring a person or damaging property. Therefore, safety devices, such as anti-drop mechanisms and obstruction detection mechanisms, are crucial.

For large scale structures such as warehouses doors, a shutter door typically comprises a steel slatted door or a continuous steel curtain with horizontal pressed ribs that allow the door to be rolled up onto a drum or barrel to open the door or warehouse entrance. Pre-tensioned counterbalance springs can be housed within the barrel assembly to balance the weight of the door as it rolls up. The doors are typically operated by a 3-phase AC motor or a DC geared motor and may use a motor current sensing safety system, whereby accidental closure of the door onto an obstruction within the doorway causes a change in the motor current which can be detected and identified by a control system to prompt a stop and re-open command. For smaller scale structures, such as residential garage doors, pressed steel ribbed doors operated by a DC motor may be used, but in many cases, heavy pressed steel doors are not practical or considered attractive. Instead, lightweight insulated roller shutter doors are desirable.

Roller garage doors and/or shutters used in residential properties typically comprise a lightweight aluminium roll formed and foam filled laths or sections that are connected by flexible joints. A roller barrel assembly situated above the doorway uses an AC drive motor to roll up the door curtain. The motor usually acts as a load carrying bearing on one side of the door and a simple roller bearing and barrel is used to support the curtain weight. The roller door is opened and closed simply by revolving the motor and barrel without the need for any counterbalance spring assistance. However, these roller doors cannot be equipped with a motor current safety system. It is therefore necessary to equip this type of roller door with a separate safety device or system.

Several safety systems are known in the art. In one example, known as a "safety edge", a rubber weather seal strip is fitted to the bottom edge of the roller door. The safety edge has electrical contact strips or an optical beam contained within the rubber seal to detect when the rubber strip is compressed by an obstruction. The test methods used to show that a particular roller door having the safety edge system satisfies the safety requirements involve closing the bottom edge of the door onto a 100 mm diameter load cell in various positions within the doorway. Upon contact, the force on the load cell must be kept below a threshold value for a predefined time period before a command to re-open is activated. Although garage roller doors fitted with a safety edge normally pass the load cell test, the safety edge may not detect larger, more realistic obstructions encountered in a residential garage doorway, e.g. a person or car roof. This is because garage roller doors weight very little (typically about 5.5 kg per $m^2$) and the resulting pressure on a larger length of the safety edge may not be sufficient to compress the rubber. In addition, the safety edge will not detect objects placed/leaning against the sides of the doorway, and the rubber strip is susceptible to freezing in cold conditions and degradation over time (e.g. UV degradation and/or animals chewing through the soft rubber) which compromise the performance. An alternative safety edge arrangement is to integrate micro switch sensors into the flexible hinge couplings between the bottom two slats/laths to detect any relative displacement of the bottom slat/lath caused by an obstruction.

Another known solution is a photoelectric cell or a light grid system, whereby one or more optical beams (typically infrared beams) are directed across the doorway towards corresponding detectors or reflective targets, such that any obstruction(s) blocking one or more beams can be detected to activate a stop and re-open command. Unlike safety edge systems that respond to an actual collision, light grid systems can prevent collisions. As such, these optical systems can be practical and effective. However, they cannot detect an obstruction in the doorway below the height of the single/lowest optical beam. In addition, they may be difficult to install, requiring a high level of technical competence, and may be prohibitively expensive to some users.

Aspects and embodiments of the present invention have been devised with the foregoing in mind.

SUMMARY OF THE INVENTION

According to a first aspect of the invention, there is provided a safety device for a movable barrier system, the barrier system comprising a barrier movable between an open position and a closed position along a guide track. The safety device comprises: a position sensor mountable, in use, to or adjacent to the guide track or the barrier; a target mountable, in use, to or adjacent to the other of the barrier or the guide track, such that movement of the barrier causes relative movement between the position sensor and the target; and a controller, in use, in communication with the position sensor. The position sensor may be configured to detect movement of the target relative to the position sensor and provide an output signal to the controller. The controller may be configured, in use, to: receive the output signal from the position sensor; determine one or more signal characteristics from the output signal; and compare the one or more determined signal characteristics with one or more predetermined signal characteristics to determine if the relative movement between the target and the position sensor is within a predefined range.

The one or more signal characteristics may be associated with a relative movement characteristic. The one or more predetermined signal characteristics may be associated with a predefined relative movement characteristic. The one or more relative movement characteristics may comprise a relative barrier displacement, position and/or barrier speed. Comparing the one or more determined signal characteristics with the one or more predetermined signal characteristics, may comprise determining if the relative movement characteristic is within a predefined range of the predetermined the relative movement characteristic.

Advantageously, the safety device may be a standalone device that can be retro-fitted to an existing barrier system, requiring little or no specialist expertise and almost no interfering with the barrier system. In addition, the safety device may be simpler and lower in cost than existing safety devices and less prone to environmental degradation. The safety device may be suitable for movable barrier systems, including but not limited to: automated doors, such as a garage doors, or automated window or kiosk shutters.

Advantageously, the safety device is responsive to relative barrier movement rather than, e.g. motor current and/or motor rpm. In this way, the safety device may be able to determine an obstruction in the opening and/or abnormal barrier movement at the earliest possible opportunity. For example, in systems that rely on monitoring motor current and/or motor rpm for obstruction detection, the motor may continue to turn even in the event that the barrier is obstructed and no longer moving, which may delay or even prevent the detection of an obstruction.

The controller may be further configured, in use, to: in response to determining the relative movement between the target and the position sensor to be outside the predefined range, send a signal to the barrier system to stop movement of the barrier.

In use, the barrier may be moveable from an open to closed position to cover/uncover an opening in a structure. The barrier may be or comprise a plurality of laths or slats extending across a width of the barrier. The barrier may comprise an upper end connected to a driven barrel or shaft for moving the barrier between the open and closed positions. The barrier may comprise a lower end. The lower end may be suspended from the driven barrel or shaft. Movement of the barrier between the open and closed positions may comprise lifting or lowering the barrier and/or the lower end of the barrier, e.g. to cover/uncover the opening in the structure. In the closed position, the lower end of the barrier may be positioned at or near the bottom of the opening.

In use, the target may be mounted to the barrier at or near and/or in close proximity to the lower end of the barrier. For example, the target may be located at a position substantially in the range 20-50 mm from the lower end of the barrier, or at a distance of approximately 10 mm, 15 mm, 20 mm, 25 m, 30 mm, 35 mm. 40 mm, 45 mm, 50 mm, 55 mm, 60 mm, 65 mm or 70 mm from the lower end of the barrier.

The controller may continuously monitor the output sensor signal to detect normal (within the predefined range) or abnormal (outside the predefined range) movement of the barrier, and send a stop and optional re-open command to the barrier system in the event that abnormal movement of the barrier is detected. Abnormal movement, or relative movement between the target and the position sensor being outside the predefined range, may result from the barrier hitting an obstacle preventing further movement of the barrier (i.e. no relative movement between the position sensor and the or each target), or free fall of the barrier (i.e. faster than expected movement between the position sensor and the or target).

The one or more signal characteristics and the one or more predetermined signal characteristics may be or comprise a time interval. Additionally or alternatively, the predefined range may be or comprise a time interval.

Alternatively or additionally, the one or more signal characteristics, predetermined characteristics and/or predefined range may be or comprise a rate, e.g. the rate of change of position of the target with respect to the position sensor, or vice versa. Alternatively or additionally, the one or more signal characteristics, predetermined characteristics and/or predefined range may be or comprise a number count.

The one or more predetermined signal characteristics may be dependent upon the expected speed and/or direction at/in which the or each target moves relative to the position sensor (or vice versa), i.e. the speed and/or direction at/in which the barrier is expected to move.

The output signal from the position sensor may be or comprise a sequence of signals. The sequence of sensor signals may be variations in the output signal, e.g. variations in the signal magnitude and/or sign. The sequence of sensor signals may be or comprises a sequence of pulses. The signal pulses may be or comprise positive pulses (i.e. peaks) and/or negative pulses (i.e. dips). Relative movement between the or each target and the position sensor as the barrier opens/closes may produce a unique sequence of sensor signals which enables the safety device to determine if the relative movement between the target(s) and the position sensor is normal, abnormal, or if there is no relative movement at all.

In this way, the one or more signal characteristics and the one or more predetermined signal characteristics may be or comprise a time interval between signal pulses, e.g. the interval between each successive signal pulse or the interval between any two signal pulses in the sequence. Additionally or alternatively, the one or more predetermined signal characteristics may be or comprise a time interval between any signal pulse and a sequence start time. For example, a barrier close sequence may be initiated at time $T_0$, and a signal pulse may be received at time $T_N$, where N is the number of the signal pulse in the sequence. The signal pulse may be the first signal pulse in the sequence. In this way, the first time interval $T_1-T_0$ may be monitored to detect the initial movement of a barrier from an open position to a position where the target is first detected by the position sensor.

In use, normal and/or abnormal movement may be determined by comparing the determined sequence time intervals, rates or counts (i.e. the one or more signal characteristics) to an expected sequence time interval (i.e. the one or more predetermined signal characteristics). The expected time interval may be dependent on the expected speed and/or direction of movement of the barrier. If the determined sequence time intervals, rates or counts are within a predefined range of the expected sequence time intervals, rates or counts, then the barrier (or target/position sensor) may be determined to be moving normally. If the determined sequence time intervals, rates or counts are outside of a predefined range of the expected sequence time intervals, rates or counts, then the barrier (or target/position sensor) may be determined to be moving abnormally. The predefined range may be determined by an upper and/or lower threshold value for the one or more determined sequence time intervals, rates or counts.

The position sensor may be configured to output a sensor signal when the or each target is within a detection range. In this way, the position sensor will only output a signal when the target passes or is coincident with the position sensor, or where the position sensor passes or is coincident with the target. The detection range may be a range in the direction of movement of the barrier. Additionally or alternatively, the detection range may be a range in a direction perpendicular to the direction of movement of the barrier. The detection range may be a characteristic of the position sensor and/or the target(s).

In an embodiment, the detection range may be approximately 10 mm, 20 mm, 40 mm, 60 mm, 80 mm, 100 mm, 120 mm, 140 mm, 160 mm, 180 mm, or 200 mm.

The position sensor may be or comprise a plurality of sensors. The plurality of sensors may be a plurality of individual sensors. Alternatively or additionally, the plurality of sensors may be or comprise an array of sensors. The sensor array may be a linear array or a curvilinear array of sensors. For example, the plurality of sensors may be an array of sensors in the direction of movement of the barrier. Each of the plurality of sensors may be configured to output a sensor signal when the or each target is within a detection range. In this way, the sequence of signal pulses may be generated by the or each target passing each of the plurality of sensors within the detection range.

The plurality of sensors of the position sensor may comprise two or more groups of sensors, each group of sensors connected to a resistor of a different resistance. Each group of sensors may comprise one or more sensors. Where a group comprises more than one sensor, the sensors may be adjacent one another in the position sensor. The sensor signal may be a sensor signal value. The sensor signal value may be a voltage. The sensor signal value provided by the or each sensor in a group of sensors may be substantially the same. The sensor signal value provided by the or each sensor in a first group of sensors may be substantially different to the sensor signal value provided by the or each sensor in a second group of sensors.

The position sensor may be configured to provide a plurality of different sensor signal values depending on the position of the target or barrier with respect to the sensors or groups of sensors. Each sensor signal value may provide a different barrier position status/condition to the controller. The controller may be configured to determine a barrier position based on the barrier position status/condition. The sensor signal value provided by each group of sensors may provide a different barrier position status/condition to the controller. For example, a first group of sensors may be or comprise the sensor positioned closest to the lower end of the barrier and provide a first sensor signal value when the target is within a detection range of the first group of sensors. The first sensor signal may be indicative of a first barrier position status/condition. A second group of sensors may comprise the rest or a subset of the rest of the plurality of sensors and provide a second sensor signal value when the target is within a detection range of the or each sensor in the second group of sensors. The second sensor signal may be indicative of a second barrier position status/condition. The position sensor may be configured to provide third sensor signal value when the target is not within a detection range of any sensors.

The position sensor may comprise a resistor, resistor arrangement or resistor network. The resistor arrangement/resistor network may be connected to one or more of the plurality of sensors. The resistor arrangement/network may be configured to vary the sensor signal (e.g. voltage) outputted to the controller depending on the position of the target relative to the position sensor. For example, one or more of the plurality of sensors may be configured to output a different sensor signal to the controller when the or each target is within a detection range (e.g. compared to when it is not in range). In this way, the controller can determine the position of the barrier between the open and closed positions and direction of movement of the barrier at any time during a barrier open or close cycle, even when and/or after barrier movement is interrupted/stopped and/or the direction of movement is changed/reversed mid-travel.

The resistor arrangement/network may be or comprise a plurality of resistors, for example at least one resistor connected in series and/or parallel with/to a respective one of the plurality of sensors (e.g. a resistor in series between a sensor output terminal and the controller) to vary the sensor signal received by the controller. The resistors may have the same or different resistances, or two of more of the resistors may have the same resistance.

The position sensor may comprise a sensor circuit comprising the plurality of sensors. The sensor circuit may further comprise the resistor network. The sensors may be connected in parallel to current and/or voltage supply lines of the circuit for providing an operating current and/or voltage to the sensors. The sensor circuit may further comprise one or more control elements configured to control the current/power supplied to each sensor or a sub-group of sensors. The or each control element may be or comprise an integrated circuit. The control element may be configured to control the current/voltage supplied to each sensor (or each sensor in a sub-group) such that current/voltage is supplied to each respective sensor periodically. This may reduce the duty cycle.

The control element may be configured to control the current/voltage to be supplied to each sensor for an ON period of time, followed by an OFF period with substantially no current/voltage. The ON period for each sensor may be shifted in time such that only one sensor (or sensor in a sub-group of sensors) is ON and powered (i.e. drawing current) at any given time. Where there are several sub-groups of sensors, each controlled by a control element, a sensor from each sub-group may be ON at the same time. In this way, the required current to operate the plurality of sensors or the group of sensors is substantially reduced.

The sensor circuit may comprise a circuit board, such as a printed circuit board, for mounting and/or connecting the sensors (and, where present, resistors and/or control elements) to the controller. The circuit board may be substantially elongate. The sensor circuit may comprise a plurality of separate circuit boards connected together to form a series or chain of interconnected circuit boards. Each of the plurality of circuit boards may be or comprise a sensor sub-circuit. The plurality of circuit boards may be electrically connected via one or more electrical connectors. Each of the plurality of circuit boards may comprise an electrical connector for connecting to another of the plurality of circuit boards. The or each electric connector may be or comprise a conductive wire. In use, the or each wire or plug may extend between respective electrical contacts of the connected circuit boards. The or each wire may be or comprise a surface mounted wire. The surface mounted wire may extend in a substantially lateral direction from an end of the respective circuit board for mounting to the surface of another circuit board, e.g. by soldering. Alternatively, the or each electrical connector may be or comprise a plug/socket or male/female connector. A plug/male connector on one circuit board may connect to a socket/female connector on an adjacent circuit board, e.g. in a push fit manner. The surface mounted electrical wires and/or plug/socket connectors may simplify assembly of the system compared to connections via through-hole soldered wires.

The plurality of sensors may be arranged, in use, on or adjacent to the guide track. For example, the plurality of sensors may be attached or mounted directly on or to the guide track, or may be attached or mounted on or to a structure adjacent to the guide track. The criteria being that, in use, the plurality of sensors are arranged within a detection range of the or each target.

The plurality of sensors may be arranged, in use, on or adjacent to the guide track at regular or irregular intervals in a direction of movement of the barrier. For example, the sensors may be spaced regularly or irregularly along the guide track or a structure adjacent the guide track.

Additionally or alternatively, the target may be a plurality of targets. The plurality of targets may be arranged, in use, on the barrier at regular or irregular intervals in a direction of movement of the barrier. The targets may be spaced regularly or irregularly along the barrier.

Alternatively, the plurality of sensors may be arranged, in use, on the barrier, and the or each target may be arranged, in use, on or adjacent to the guide track. The sensors and/or the targets may be arranged/spaced at regular or irregular intervals in a direction of movement of the barrier.

The plurality of sensors and/or the plurality of targets may comprise any number of sensors and/or targets. For example, the number of sensors and/or targets may be any of: 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40, or any number between 40 and 100.

In use, the lateral separation between the or each target and the or each sensor may be substantially less than 10 mm, 20 mm, 40 mm, 60 mm, 80 mm, 100 mm, 120 mm, 140 mm, 160 mm, 180 mm, or 200 mm. In use, the lateral separation between the or each target and the or each sensor may be substantially in the range 10 mm to 20 mm, 20 mm to 40 mm, 40 mm to 60 mm, 60 mm to 80 mm, 80 mm to 100 mm, 100 mm to 120 mm, 120 mm to 140 mm, 140 mm to 160 mm, 160 mm to 180 mm, or 180 mm to 200 mm.

The positioning and/or spacing of the plurality of sensors and/or target(s) may, at least in part, determine the sensor signal sequence received by the controller. The positioning and/or spacing of the plurality of sensors and/or target(s) may determine, at least in part, the one or more predetermined signal characteristics.

The response time ΔT of the safety device may be determined, at least in part, by the time separation between successive signal pulses (i.e. $\Delta T \approx T_{N-1} - T_N$) and/or the frequency of signal pulses. The response time may be determined, at least in part, by the spacing of the sensors and/or the targets. Alternatively or additionally, the response time may be determined, at least in part, by the speed of the barrier movement. In an embodiment, the response time may be substantially 750 ms or less. In another embodiment, the response time may be substantially in the range 100 ms to 750 ms. In another embodiment, the response time may be approximately 100 ms, 150 ms, 300 ms, 400 ms, 500 ms, 600 ms, or 700 ms.

The one or more signal characteristics may be or comprise a barrier speed (e.g. upward or downward movement). The controller may be configured to determine the speed of barrier movement through the sequence of sensor signals and the spacing between one or more sensors and/or targets.

The position sensor may be or comprise any type of sensing technology suitable for detecting relative movement of a target. The position sensor may be a contactless position sensor. In other words, the position sensor may be capable of detecting the or each target within a detection range without physically contacting the or each target. Advantageously, a contactless position sensor does not suffer from physical wear and tear and therefore lower the maintenance of the safety device and the cost associated with replacement parts.

The position sensor may be or comprise a magnetic sensor, an optical sensor, and/or acoustic sensor such as an ultrasonic sensor. The position sensor is configured to provide an output signal when the or each target is within a detection range. However, the or each target may be or comprise an active target or a passive target. An active target may emit a signal that is detectable by the position sensor (e.g. light or magnetic field). A passive target may present an object, barrier or surface, which, upon passing the position sensor within a detection range causes the output signal of the position sensor to change.

Where the position sensor is or comprises a magnetic field sensor, the or each target may be or comprise a magnet. The magnet may be or comprise a permanent magnet or an electromagnet. The or each magnet may be a two-pole magnet. The two pole magnet may be arranged, in use, such that the poles of the magnet are aligned parallel (e.g. vertically) with or perpendicular (e.g. horizontally) to the direction of movement of the barrier.

Where the poles of the magnet are aligned parallel to the direction of movement of the barrier, the magnetic field emanating from each pole of the magnet may produce a separate signal as the magnet passes a given magnetic field sensor. In this way, the number of sensor signals in a sensor signal sequence may be increased without increasing the number of sensors. This may reduce the response time ΔT and the component costs of the safety device.

Advantageously, where the poles of the magnet are aligned perpendicular to the direction of movement of the barrier, the detection range may be increased compared to aligning the magnet pole parallel to the direction of movement of the barrier. This may allow for better tolerance to bad fitting of the safety device to a barrier system. For example, aligning the magnet perpendicular to the direction of movement of the barrier may increase the allowable gap between the magnet and the magnetic field sensor, e.g. from 10 mm to 40 mm.

Where the position sensor is or comprises an optical sensor such as a photodetector, the or each target may be or comprise an active target. The active target may be or comprise a light emitting device, such as light emitting diode, laser, or fluorescent device. In this case, the light emitted from the or each light emitting device may be in the visible or in the infrared wavelength range.

Alternatively, where the position sensor is an optical sensor, the or each target may be or comprise a passive target. The passive target may be or comprise a surface, roughened surface or grating, such that, when within the detection range, light reflected/scattered from/by the or each target may be detected by the optical sensor. In this case, the scattered/reflected light may be ambient light or light emitted from a light emitting device. For example, a light emitting device may be used in conjunction with the optical sensor (e.g. integrated with or positioned adjacent the optical sensor).

Where the position sensors is an ultrasonic sensor, the or each target may be or comprise a passive target such as a barrier or surface that, when within the detection range, reflects the sound wave emitted from the ultrasonic sensor back to the sensor which is detected.

Advantageously, passive targets and permanent magnets do not require power to function.

The position sensor may be housed in a sensor housing. Advantageously, the sensor housing may protect the position sensor from the environment (e.g. from moisture and dust). Additionally or alternatively, the or each target may be housed in a target housing.

According to a second aspect of the invention, there is provided a movable barrier system comprising a barrier movable between an open position and a closed position along a guide track and the safety device of the first aspect, including any of the optional features thereof, in any combination.

According to a third aspect of the invention, there is provided a method of detecting movement of a barrier, the barrier being movable between an open position and a closed position along a guide track. The method comprises: receiving an output signal from a position sensor, the position sensor being mountable to one of the barrier and the guide track and configured to detect relative movement between the position sensor and a target mountable to the other of the barrier and the guide track; determining one or more signal characteristics from the output signal; and comparing the one or more signal characteristics with one or more predetermined signal characteristics to determine if the relative movement between the target and the position sensor is within a predefined range.

The method may further comprise sending a signal to the barrier to stop movement of the barrier, in response to determining the relative movement between the target and the position sensor to be outside the predefined range.

The one or more signal characteristics and the one or more predetermined signal characteristics may be or comprise a time interval. Additionally or alternatively, the predefined range may be or comprise a time interval.

The output signal from the position sensor may be or comprise a sequence of signal pulses. The sequence of sensor signals may be variations in the output signal, e.g. variations in the signal magnitude and/or sign. The sequence of sensor signals may be or comprises a sequence of pulses. The signal pulses may be or comprise positive pulses (i.e. peaks) and/or negative pulses (i.e. dips). Relative movement between the or each target and the position sensor as the barrier opens/closes may produce a unique sequence of sensor signals which enables the safety device to determine if the relative movement between the target(s) and the position sensor is normal, abnormal, or if there is no relative movement at all.

In this way, the one or more signal characteristics and the one or more predetermined signal characteristics may be or comprise a time interval between signal pulses, e.g. the interval between each successive signal pulse or the interval between any two signal pulses in the sequence. Additionally or alternatively, the one or more predetermined signal characteristics may be or comprise a time interval between any signal pulse and a sequence start time.

The step of determining one or more signal characteristics from the output signal may further comprise determining a time interval between signal pulses and/or a time interval between a signal pulse and a sequence start time.

The position sensor may be or comprise a plurality of sensors. Each of the plurality of sensors may be configured to output a sensor signal when the or each target is within a detection range.

Advantageously, the method may determine normal and/or abnormal movement of the barrier by comparing the determined sequence time intervals, rates or counts (i.e. the one or more signal characteristics) to an expected sequence time interval (i.e. the one or more predetermined signal characteristics). The expected time interval may be dependent on the expected speed and/or direction of movement of the barrier. If the determined sequence time intervals, rates or counts are within a predefined range of the expected sequence time intervals, rates or counts, then the barrier (or target/position sensor) may be determined to be moving normally. If the determined sequence time intervals, rates or counts are outside of a predefined range of the expected sequence time intervals, rates or counts, then the barrier (or target/position sensor) may be determined to be moving abnormally. The predefined range may be determined by an upper and/or lower threshold.

The method may be performed using an apparatus according to the first aspect, including any of the optional features thereof, in any combination.

Features which are described in the context of separate aspects and embodiments of the invention may be used together and/or be interchangeable. Similarly, where features are, for brevity, described in the context of a single embodiment, these may also be provided separately or in any suitable sub-combination. Features described in connection with the system may have corresponding features definable with respect to the method(s) and these embodiments are specifically envisaged.

BRIEF DESCRIPTION OF DRAWINGS

In order that the invention can be well understood, embodiments will now be discussed by way of example only with reference to the accompanying drawings, in which.

DETAILED DESCRIPTION

Figure 1:
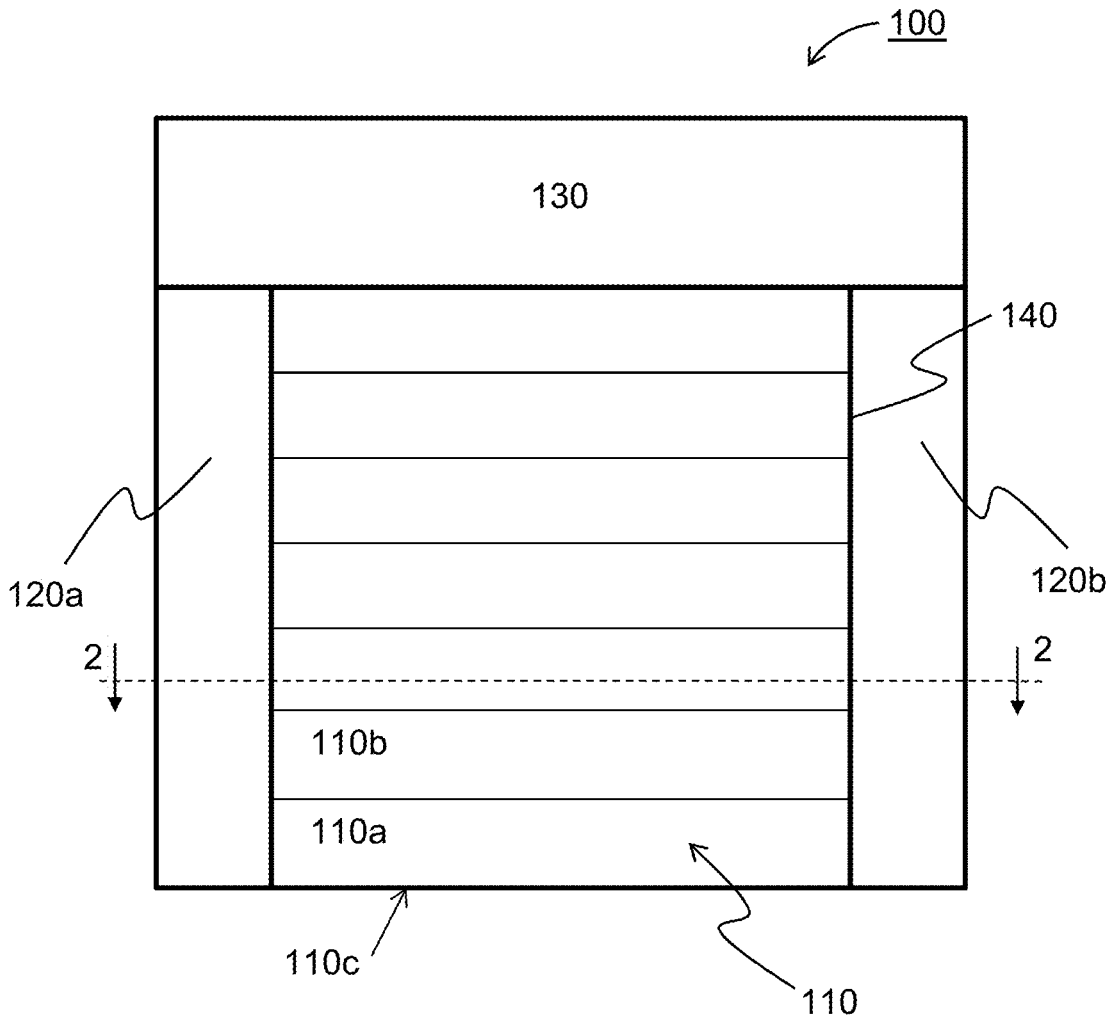
FIG. 1 shows a schematic illustration of a movable barrier system.

FIG. 1 shows a schematic illustration of a movable barrier system 100. The system 100 comprises a barrier 110, configured to move between a closed position (as shown) covering an opening 140 in a structure (e.g. a garage doorway) and an open position (not shown), along a pair of opposing guide tracks 120*a*, 120*b*. The barrier 110 comprises an upper end connected to a driven barrel or shaft (not shown) and a lower end 110*c* suspended from the driven barrel. The driven barrel may be housed within a barrel assembly 130 above the opening 140.

The barrier 110 may be or comprise a flexible barrier of the roll-up type, known as a curtain. In this way, rotation of the barrel causes the barrier 110 to roll up around, or un-roll from, the barrel to move the barrier 110 between the open and closed positions, respectively. The barrier 110 may be operable to move between any two positions between the open and closed positions.

The barrier system 100 may be suitable for use as a residential garage door, window shutter, kiosk shutter, as well as numerous other applications.

Figure 2:
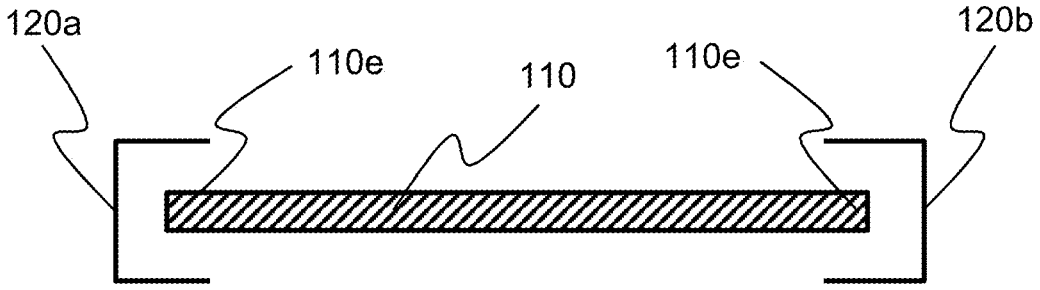
FIG. 2 shows a cross-sectional view of the movable barrier system of FIG. 1.

In the closed position, the lower end 110*c* of the barrier 110 may be positioned at or near the bottom of the opening 140 (e.g. ground level), as shown in FIG. 1. In the open position, the lower end 110*c* of the barrier 110 may be positioned at or near the top of the opening 140 (not shown). The barrier 110 may further comprise a suspended portion extending between the lower end 110*c* and the barrel. As such, the drop length of the suspended portion may vary as the barrier 110 is opened and closed. Transverse edges 110*e* of the lower end 110*c* and the suspended portion of the barrier 110 may be at least partially received within their respective guide tracks 120*a*, 120*b*, as shown in FIG. 2. The guide tracks 120*a*, 120*b* serve to guide the movement of the lower end 110*c* and the suspended portion of the barrier 110 between the open and closed positions, add rigidity to the barrier 110 when in the closed position and help to prevent forced entry through the barrier 110. In an alternative arrangement, the guide tracks 120*a*, 120*b* may be at least partially received within the transverse edges 110*e* of the lower end 110*c* and the suspended portion of the barrier 110.

The barrier 110 may be or comprise a plurality of laths or slats 110*a*, 110*b* extending across a width of the barrier 110, as shown in FIG. 1. The laths 110*a*, 110*b* may be or comprise a metal construction. For example, the laths 110*a*, 110*b* may comprise roll formed aluminium, or steel, or one or more other materials. Optionally or preferably, the laths 110*a*, 110*b* may further comprise insulating material, such as insulating foam. Additionally or alternatively, the laths 110*a*, 110*b* may comprise a plastic skin on one or both sides of the metal layer. The insulating material may be located within the core of the laths 110*a*, 110*b*, or on one side of the laths 110*a*, 110*b*. The laths 110*a*, 110*b* may be connected by one or more flexible joints (not shown) known in the art to allow the barrier 110 to be rolled-up around the barrel. For example, the flexible joints may be or comprise interlocking scrolls that extend from the laths 110*a*, 110*b* to form hinge joints. The scrolls may be integral with the lath construction or may be separate components. Alternatively, the flexible joint may be or comprise strapping, such as a plastic or a woven fabric.

In the open position, the barrier 110 may be entirely or at least substantially contained within the barrel assembly 130. Movement of the barrier 110 between the open and closed positions may comprise lifting or lowering the barrier 110 and/or the lower end 110*c* of the barrier 110.

The driven barrel or shaft may be driven by a motor, under the control of a controller (not shown). The controller may operate the barrel assembly 130 in response to an input signal, e.g. from a user input device, one or more sensors, and/or a safety device (such as that described below). The user input device may be in wired and/or wireless data communication with the controller. For example, the user input device may be or comprise a control panel or switch on or near the structure. Additionally or alternatively, the user input device may be or comprise a remote/portable wireless device. The wireless user input device may communicate with the controller via any wireless technology known in the art, for example, RF communication.

Figure 4:
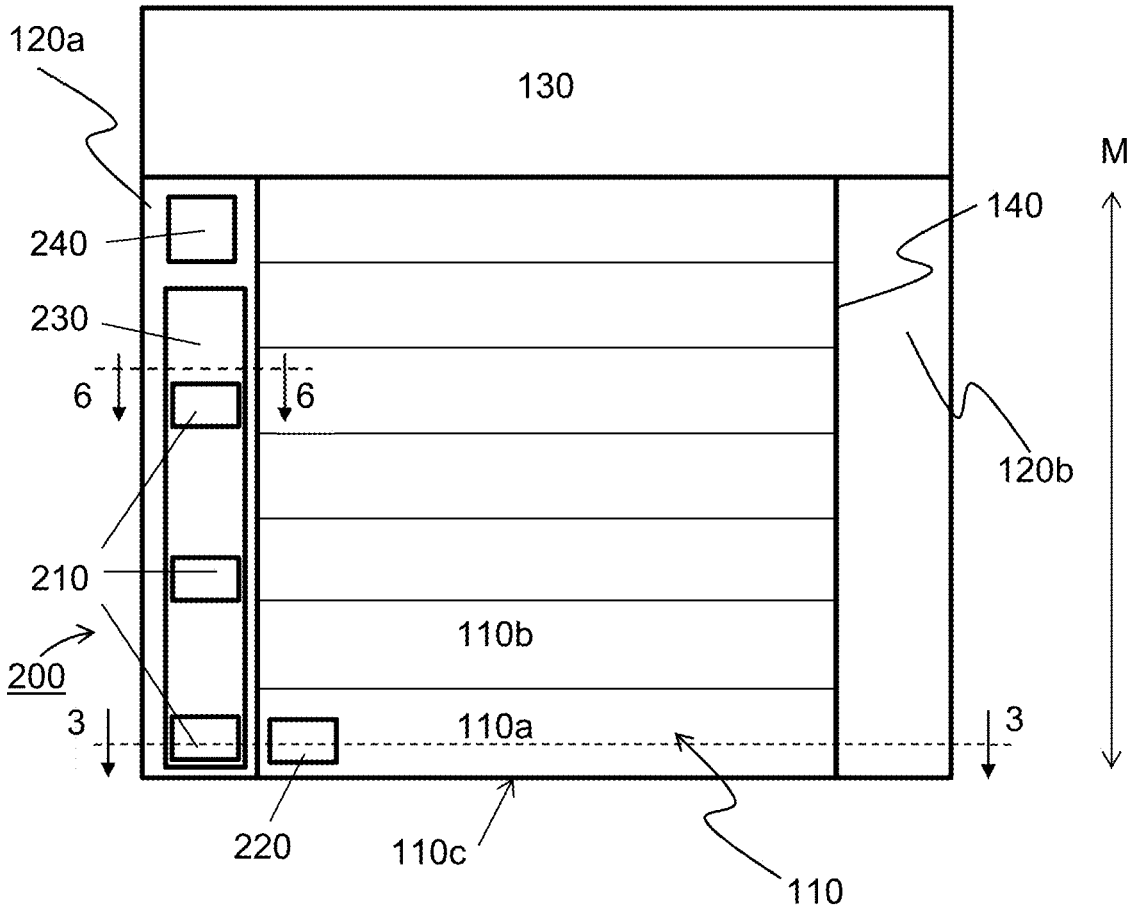
FIG. 4 shows a schematic illustration of the movable barrier system of FIG. 1 with a safety device.

According to an embodiment of the invention, the system 100 further comprises a safety device 200. The safety device 200 may be retro-fitted into an existing barrier system 100. The safety device 200 comprises a position sensor that can be attached to one or both sides of the barrier 110 and/or to one or both sides of the doorway, such as a guide track 120*a*, 120*b*, as shown in FIG. 4. The position sensor is configured to detect movement of the barrier 110 relative to the doorway/guide tracks 120*a*, 120*b*. In particular, the safety device 200 is configured, in use, to monitor movement of the barrier 110 and to detect an interruption in the expected movement of the barrier 110 that may be caused by an obstruction in the doorway.

Figure 3:
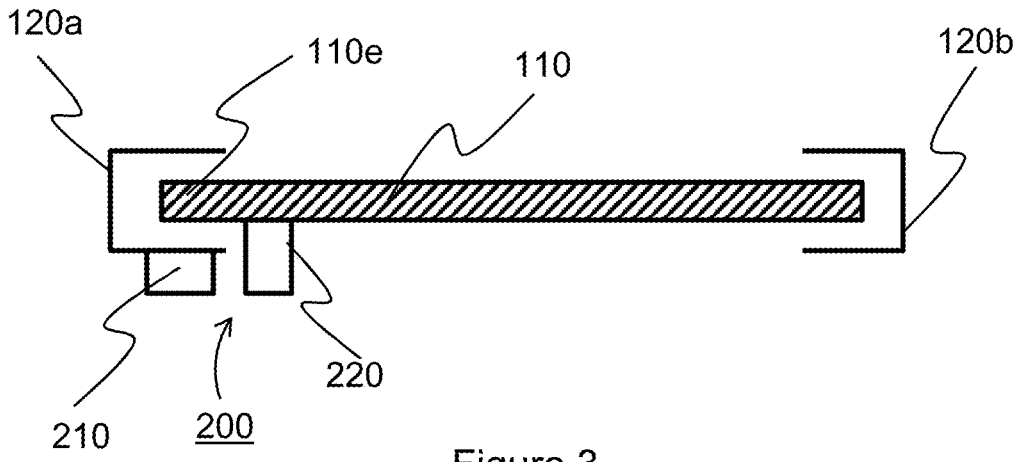
FIG. 3 shows a cross-sectional view of the movable barrier system of FIG. 1 with a safety device.

In an embodiment, the position sensor comprises a plurality of sensors 210 that can be attached to or adjacent to a guide track 120*a* and a target 220 that can be attached to the barrier 110 in the vicinity of the respective guide track 120*a*, as shown in FIGS. 3 and 4. The plurality of sensors 210 are positioned at predetermined locations on or adjacent to the guide track 120*a* in the direction of movement of the barrier 110 (indicated by the arrow M in FIG. 4). The or each sensor 210 is configured to produce an output signal when the target 220 moves to within a detection distance of the or each sensor 210.

Although FIG. 4 shows the plurality of sensors 210 on/adjacent to the left hand guide track 120*a*, alternatively or additionally, a plurality of sensors 210 may be attached to or adjacent to the right hand guide track 120*b*. A corresponding target 220 may then attached to the barrier 110 in the vicinity of the right hand guide track 120*a*. Sensors and targets associated with both sides of the barrier 110 may be appropriate/advantageous for larger openings 140 (e.g. having a width of greater than approximately 3000 mm).

In an embodiment, e.g. as in FIG. 4, the target(s) 220 may be located at or near the bottom/lower edge of the barrier 110. This provides for a full movement range of the target(s) with respect to the sensors 120*a* on the/each side of the barrier 110.

Figure 10:
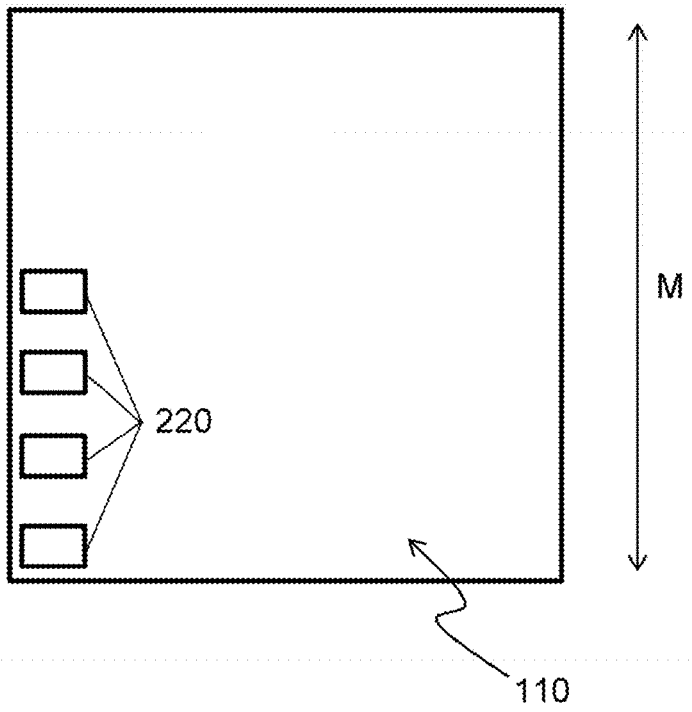
FIG. 10 shows a schematic depiction of a plurality of targets located at regular intervals along the barrier.

In addition, although only one target 220 is shown in the embodiment of FIG. 4, in another embodiment, as shown in FIG. 10, the safety device 200 may comprise a plurality of targets 220 located at predetermined locations in the direction of movement of the barrier 110. In yet a further embodiment, the safety device 200 may comprise one sensor 210 that can be attached to or adjacent to a guide track 120*a*, 120*b* and a plurality of targets 220 that can be attached to the barrier 110 at predetermined locations in the direction of movement of the barrier 110, in the manner shown in FIG. 10.

Figure 5:
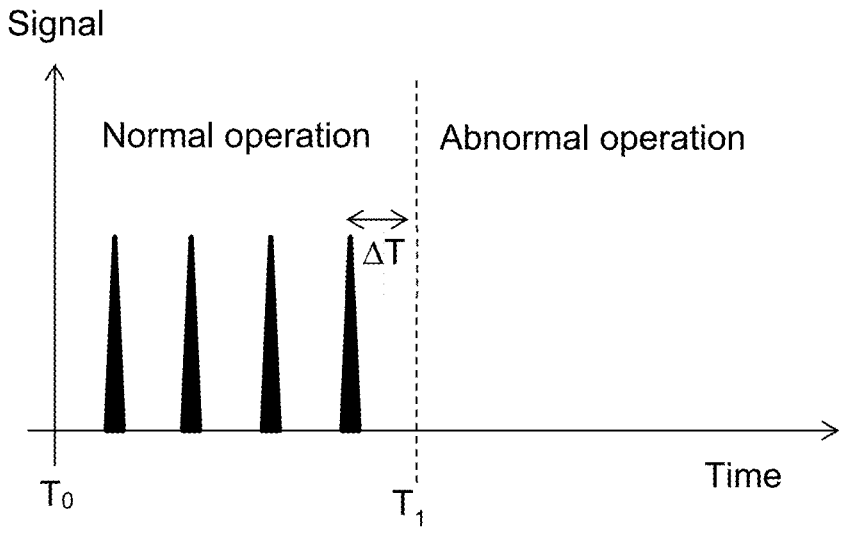
FIG. 5 shows a schematic illustration of an example signal sequence from a safety device.

In use, movement of the barrier 110 causes movement of the or each target 220 relative to the or each sensor 210. Each time a target 220 moves past a sensor 210, to within a detection distance, a signal may be outputted by the sensor 210 to a controller/processor 240. Movement of the or each target 220 relative to the or each sensor 210 as the barrier 110 opens/closes produces a unique sequence of sensor signals which enables the safety device 200 to determine if the barrier 110 is moving normally, abnormally, or not at all. For example, as shown schematically in FIG. 5 for a barrier 110 closure operation started at $T_0$, if closure has been prevented/affected due to accidental closure onto an obstruction in the doorway, a change, interruption or break in the sensor signal sequence can be determined by the controller 240. A stop and re-open command may then be sent to the controller of the barrel assembly 130, e.g. at time $T_1$. The response time ΔT may be determined by the spacing of the sensors 210, targets 220, speed of the barrier 110 movement, and/or the frequency of the sensor signals. In an embodiment, the response time is approximately 750 ms or less.

The controller 240 may determine abnormal movement of the barrier 110 by determining one or more measured sensor signal characteristics (or control parameters) from the received signal sequence and comparing the one or more measured sensor signal characteristics with one or more predetermined signal characteristics (or control parameters). The one or more measured/predetermined signal characteristics may be a time interval. For example the time interval may be a measured/expected signal time, a measured/expected separation time between each successive signal, and/or a measured/expected separation time between a signal received from each successive sensor. Alternatively or additionally, the one or more measured/predetermined signal characteristics may be a measured/expected time for the target 220 to reach the upper most sensor 210 from a fully open position, and/or the measured/expected time for the target 220 to reach each successive sensor from the fully open position. The one or more measured/predetermined signal characteristics may be dependent on the speed at which the barrier 110 moves.

Any changes from the expected signal characteristics that may be caused by obstructions within the opening 140, defects in the barrier system 100 and/or the safety device 200, may trigger the controller 240 to send a stop and re-open command to the controller of the barrel assembly 130.

The controller 240 may further be in wired or wireless communication with a barrier brake system (not shown). The brake system may be an electro mechanical system, such as a solenoid actuated brake system. A failure of the barrel assembly 130 causing a "free fall" event of the barrier 110 may be monitored and detected by the controller 240 (e.g. by the measured time periods being substantially shorter than the predetermined time periods). Upon detection of a free fall event, the controller 240 may be configured to send a stop command to the brake system to arrest movement of the barrier 110.

Although the controller 240 is shown in FIG. 4 as being positioned on a guide track 120*a*, alternatively the controller 240 may be located remotely from the barrier system 100. For example, the controller 240 may be positioned on a wall or structure near or adjacent to the barrier system 100 (not shown).

The plurality of sensors 210 may be located at regular intervals or non-regular intervals along the guide track 120*a* in the direction of movement of the barrier 110. In an embodiment, the safety device 200 comprises 18 or 26 sensors. In another embodiment, the safety device 200 may comprise any number of sensors in the range 2-30. The number of sensors 210 and/or their spacing may be determined by at least partly by the required response time and/or the height of the doorway/opening.

In an embodiment, the plurality of sensors 210 are housed within a sensor housing 230. The sensor housing 230 may be attached to or adjacent to the guide track 120*a*, as shown in FIG. 4. The sensor housing 230 may be attached to or adjacent to the guide track 120*a* using an adhesive layer and/or a mechanical mechanism (e.g. one or more screws, bolts, clamps, rivets etc.). The sensor housing 230 may be or comprise a metal or metal alloy enclosure/extrusion. In an embodiment, the metal is or comprises aluminium or steel, or one or more other materials. Alternatively, sensor housing 230 may be or comprise a plastic or composite housing/extrusion.

The sensor housing 230 may extend partially along the length of the guide track 120*a* or substantially the entire length of the guide track 120*a*. In an embodiment, where the safety device 200 is fitted to a residential movable barrier system 100, such has a garage doorway with an opening 140 of approximately 2800 mm in width and 2500 mm in height, the sensor housing 230 may be approximately 1900 mm in length. In an embodiment, the sensor housing is approximately 22 mm wide and 12 mm deep. In another embodiment, the sensor housing 230 may have a width substantially in the range 10-50 mm, and a depth substantially in the range 5-50 mm.

The sensor housing 230 may further comprise electrical wiring connecting the or each sensor 210 directly or indirectly to the controller 240. For example, the sensor housing 230 may in wired or wireless communication with the controller 240. Although shown in FIG. 4 as a separate component, the controller 240 may also be housed in the sensor housing 230. The controller 240 may further be configured to power the plurality of sensors 210, for example, by applying an AC or DC current or voltage to the or each sensor 210. Alternatively, the sensors 210 may be powered by a separate power source, e.g. a battery. The sensor housing 230 and/or the controller 240 may further comprise a visual indicator (e.g. an LED) to indicate power on and/or or scan detection of the target 220 as is passes a sensor 210.

Each of the sensors 210 may be configured to output substantially the same or a different sensor signal value (e.g. voltage) when the or each target 220 is within a given range of the sensor 210. In other words, the responsivity of each sensor 210 may be the same or different. In an embodiment, one or more of the sensors 210 is configured to output a different sensor signal to the controller 240 when the or each target 220 is within a detection range. As the sensor signal provided by each sensor 210 is associated with a position of the target 220 and barrier 110, in this way, the controller 240 can determine the position of the barrier target 220 and barrier 110 between the open and closed positions and direction of movement of the target 220 and barrier 110 at any time during a barrier open or close cycle, even when and/or after barrier movement is interrupted/stopped and/or the direction of movement is changed/reversed mid-travel.

In an embodiment, the plurality of sensors 210 form part of a sensor circuit that further comprises a resistor network connected to the plurality of sensors. The resistor network is configured to alter the sensor signal (e.g. voltage) received by the controller 240 from one or more sensors 210. In one example, each sensor 210 comprises a signal output terminal for connecting to the controller 240, and the signal output terminal of each sensor 210 is connected in series with a resistor. The resistor connected to each sensor 210 may have a different resistance. Alternatively, two or more sensors 210 may be connected to a resistor of substantially the same resistance. For example, the resistor network may be configured such that the output signal received by the controller 240 is different when: (i) the target 220 is within a detection range of the sensor 210 closest to the lower end 110*c* of the barrier 110, e.g. substantially 2.4V; (ii) the target 220 is within a detection range of the rest of the sensors 210, e.g. substantially 1.2V; and (iii) the target 220 is not with a detection range of any sensors 210, e.g. substantially 3.6V.

Figure 7:
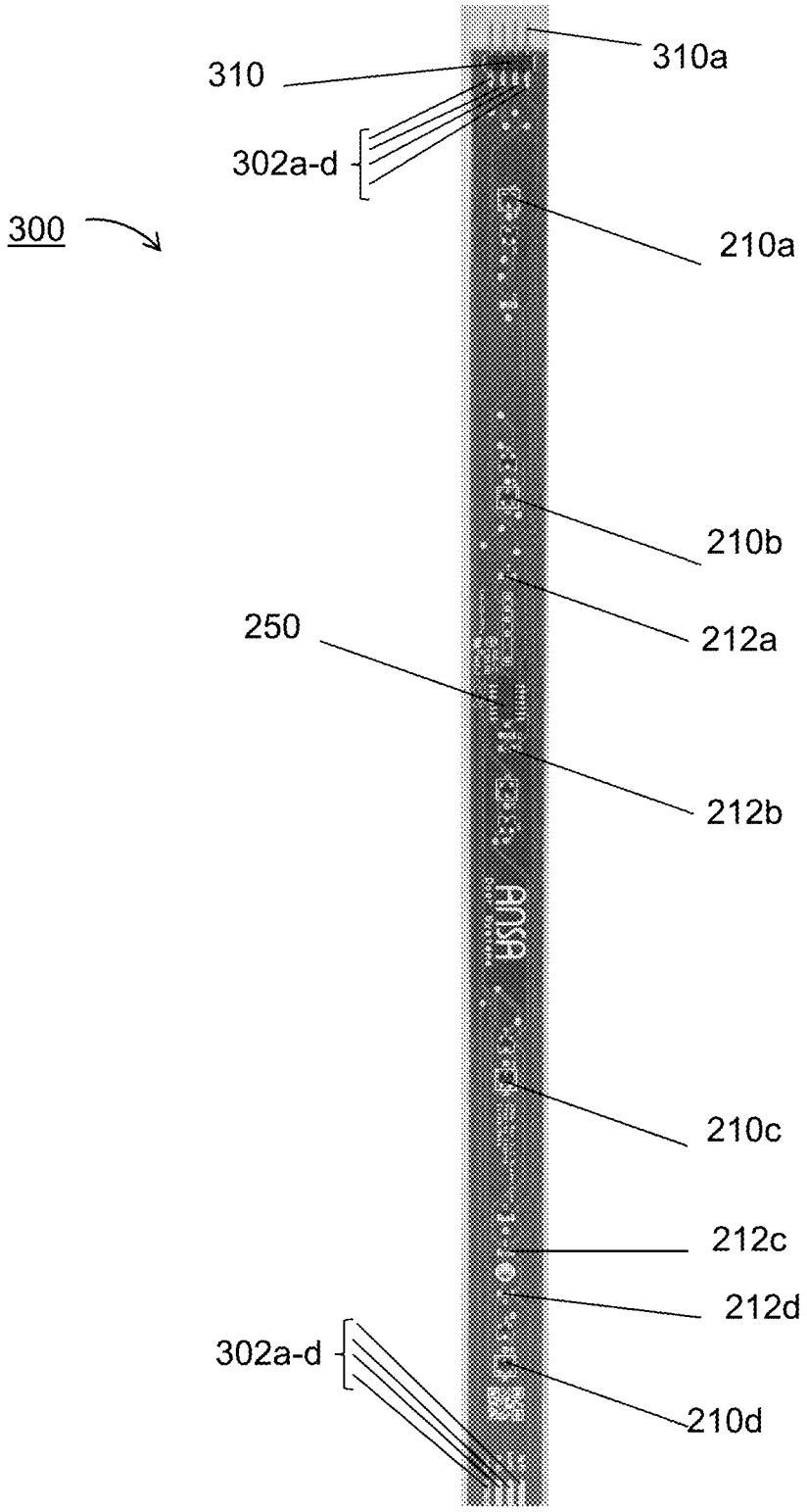
FIG. 7 shows an example of a circuit board for mounting sensors of a safety device.

The sensor housing 230 may further house a circuit board 300 for mounting and connecting up the plurality of sensors 210 to the controller 240, e.g. via a separate electrical fitting (see FIG. 7). The circuit board 300 may comprise the sensing circuit. The circuit board 300 may be substantially elongate. In an embodiment, the circuit board comprises a plurality of separate circuit boards 300 connected together to form a series or chain of interconnected circuit boards (not shown). The plurality of circuit boards 300 are electrically connected via one or more electrical connectors 310. In an embodiment, the or each connector 310 comprises a surface mounted wire 310*a* that extends in a substantially lateral direction from an end a circuit board 300 for surface mounting to another circuit board 300, e.g. by soldering. This simplifies the assembly and connection of one circuit board to another.

Figure 6:
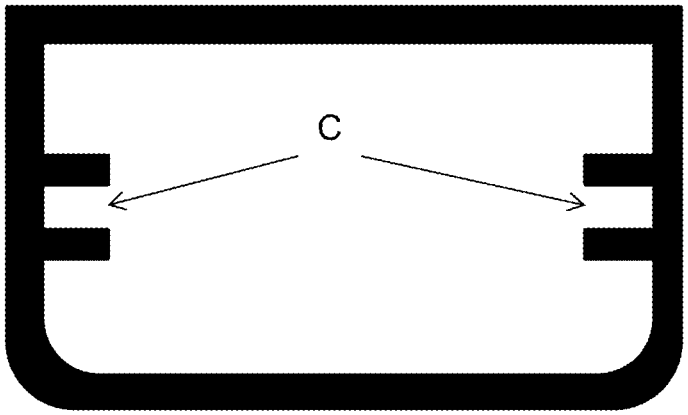
FIG. 6 shows a schematic cross-sectional view of a sensor housing.

FIG. 6 shows an example cross-section of a sensor housing 230 having a pair of opposing "C" shaped projections for mounting/securing a circuit board within the sensor housing 230.

FIG. 7 shows an example circuit board 300 comprising a sensor circuit with a plurality of sensors 210*a*-210*d*, a plurality of resistors 212*a*, 212*d* connected to each sensor 210*a*-210*d*, and a connector 310 for connecting tracks 302*a*-302*d* of the circuit board 300 to respective tracks 302*a*-302*d* of another circuit board (not shown). The circuit board 300 further comprises a control element 250 for controlling the current provided to each sensor 210*a*-210*d* (see below).

Each sensor 210 requires a certain current to operate. In cases where each sensor 210 is connected in parallel, increasing the number of sensors 210 typically increases total current required to be supplied to the sensing circuit. For example, a system of 26 sensors 210, each requiring 2 mA to operate, leads to a total quiescent current in excess of 50 mA, which can exceed the rating of certain power supplies, particularly where sensors 210 are fitted to both guide tracks 120*a*, 120*b* and powered by the same power supply. To lower the power consumption requirements, in an embodiment the sensor circuit further comprises a control element 250 such as an integrated circuit configured to control the current supplied to each sensor 210, such that current or power is supplied to each sensor 210 periodically to reduce the duty cycle. The sensor circuit may comprise one control element configured to control the current/power supplied to each sensor 210. Alternatively, the sensor circuit may comprise a plurality of control elements, each configured to control the power/current supplied to a subset of sensors 210. For example, each of the plurality of circuit boards may comprise a control element to control the power/current supplied to the sensors 210 on that circuit board.

Figure 8:
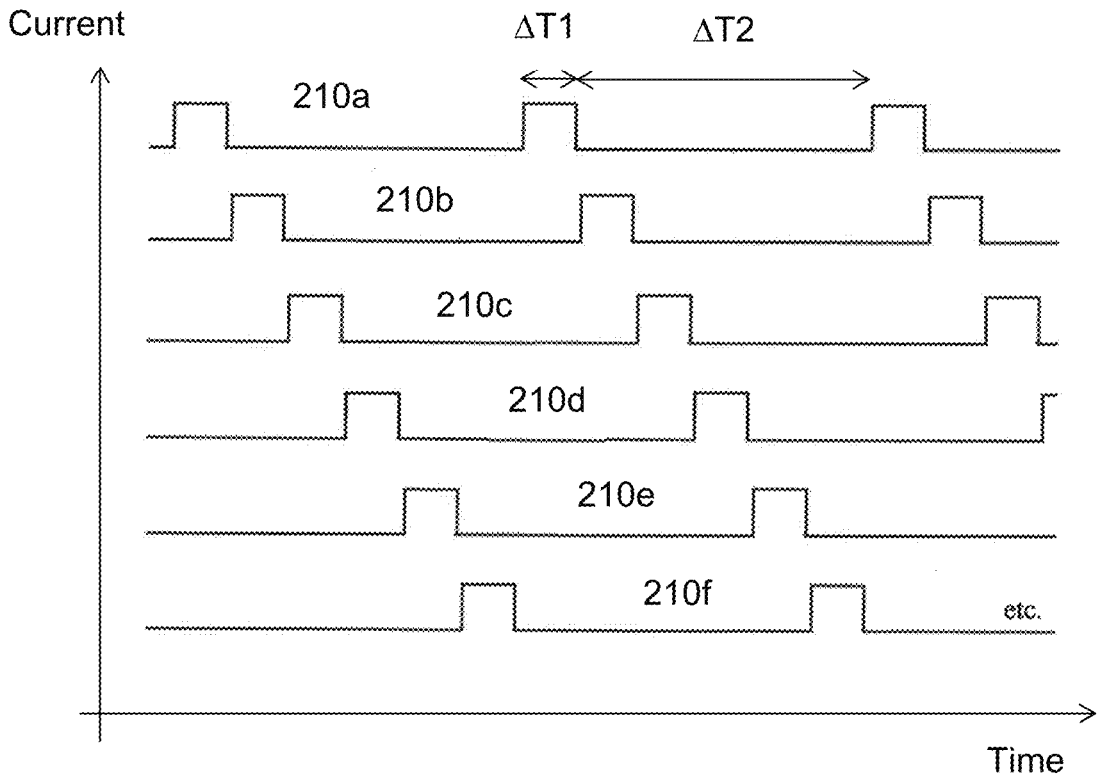
FIG. 8 shows a schematic illustration of an example current sequence supplied to sensors of a safety device.

FIG. 8 shows an example of the modulated control of current supplied to a group of 6 sensors 210*a*-201*f* by the control element in the form of a shift register with sequential outputs. Each line represents the current supplied to a separate sensor 210, which range from substantially zero to the operating current of the respective sensor 210. Current is supplied to each sensor 210*a*-210*f* for an ON period of time ΔT1, followed by an OFF period ΔT2 with substantially no current. The ON period for each sensor 210*a*-210*f* is shifted in time such that only one sensor 210*a*-210*f* is ON and powered at any given time. In this way, only a single multiple of the operating current for one sensor 210 is required to operate the whole group of sensors 210*a*-210*f*. It will be appreciated that the OFF period ΔT2 is shorter than the typical time taken for the target 220 to pass a sensor 210, to ensure that a sensor signal is not missed. For example, in the case of 26 sensors 210 each with a 2 mA operating current and the sensors are split into different groups of sensors 210*a*-210*f* (which may be mounted on separate circuit boards), each having a separate control element, the modulated control of current reduces the quiescent current to 2 mA per group, plus a little current to drive the control element. The sensor signal received by the controller 240 may be interpreted in the same way, for example by sensor signal received by the controller 240 may be a time averaged signal which is still sufficient to detect movement of the barrier 110.

In an embodiment, the target 220 is fitted to the barrier 110 in close proximity to the lower end 110*c* of the barrier 110, as shown in FIG. 4. For example, the target 220 may be located at a position substantially in the range 20-50 mm from the lower end 110*c* of the barrier 110, or at distances of approximately 10 mm, 20 mm, 30 mm, 40 mm, 50 mm, 60, or 70 mm from the lower end 110*c* of the barrier 110.

In an embodiment, the target 220 may further be fitted to the barrier 110 in close proximity to a transverse edge 110*e* of the barrier 110 nearest the plurality of sensors 210. For example, the target 220 may be positioned between approximately 20 mm to 50 mm from the transverse edge 110*e*. Alternatively or additionally, the lateral separation between the target 220 and any one of the plurality of sensors 210 may be substantially less than 20 mm, 30 mm, 40 mm, 50 mm or 60 mm.

In an embodiment, the target 220 is mounted, in use, to the lower slat 110*a* of the barrier 210, as shown in FIG. 4. Alternatively, the target 220 may be mounted, in use, to the second slat 110*b*.

The target 220 may be housed in a target housing (not shown) that can be attached to the barrier 110. The target housing may be attached to the barrier 110 using an adhesive layer and/or a mechanical mechanism (e.g. one or more screws, bolts, clamps, rivets etc.). The target housing may be or comprise a plastic or composite housing/extrusion. Alternatively, target housing may be or comprise metal or metal alloy enclosure/extrusion. In an embodiment where the target housing is a metal, the metal is or comprises aluminium or steel.

The sensor housing 230 and/or the target housing may be or comprise a dust and waterproof housing to protect the contents from the environment. For example, the sensor housing 230 and/or the target housing may be rated at IP65.

Figure 9A:
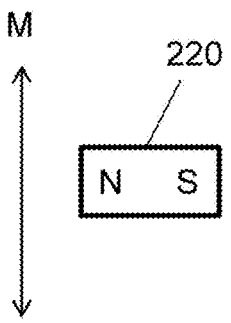
FIGS. 9(*a*) and 9(*b*) show a schematic depiction of magnetic pole orientations of a target magnet relative to a direction of movement of a barrier.
Figure 9B:
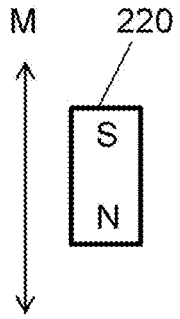

In an embodiment, the or each target 220 is or comprises a magnet, and the one or more sensors 210 is or comprises a magnetic field detector. The magnet 220 may be or comprise a permanent magnet, e.g. a two-pole bar magnet. Alternatively, the magnet 220 may be or comprise an electromagnet. Where the magnet 220 is a two-pole magnet, the magnet 220 may be arranged on the barrier 110 with its poles aligned substantially perpendicular to the direction of movement M of the barrier 110, as shown in FIG. 9(*a*). In this way, because the magnetic field emanating the magnet is greatest along the polar axis, the detection range of the sensor is increased, allowing the magnet 220 to be placed at a greater lateral distance from the or each sensor 210. This improves the tolerance of the safety device 200 to variations in the lateral separation between the magnet 220 and each sensor 210.

The or each magnetic field sensor 210 may be or comprise a Hall effect sensor or a magnetoresistance sensor, or a combination of different types of magnetic field sensors. In embodiment, the or each magnetic field sensor has a minimum detectable magnetic field substantially in the range of 1 to 20 Gauss (0.1 mT to 2 mT). In this embodiment, for a signal to be detected from the or each sensor 210 as the or each target 220 passes, the lateral separation of the or each magnetic field sensor 210 from the or each magnet 220 may be less than the distance at which the magnetic field from the magnet drops below the minimum detectable field of the sensor 210.

Although the above description focuses on embodiments where the one or more sensors 210 are attached to or adjacent to a guide track 120*a*, 120*b* and the one or more targets 220 are attached to the barrier 110 (i.e. the one or more sensors 210 are fixed and the one or more targets 220 move with the barrier 210), it will be appreciated that in an alternative arrangement, the one or more sensors 210 may be attached to the barrier 110 and the one or more targets 220 may be attached to or adjacent to the guide track 120*a*, 120*b*.

From reading the present disclosure, other variations and modifications will be apparent to the skilled person. Such variations and modifications may involve equivalent and other features which are already known in the art, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination.

For the sake of completeness it is also stated that the term "comprising" does not exclude other elements or steps, the term "a" or "an" does not exclude a plurality, and any reference signs in the claims shall not be construed as limiting the scope of the claims.

The invention claimed is:

1. A safety device for a movable barrier system comprising a barrier movable between an open position and a closed position along a guide track, the safety device comprising:

a position sensor mountable, in use, to or adjacent to the guide track;

a target mountable, in use, to the barrier, such that movement of the barrier causes relative movement between the position sensor and the target;

a controller, in use, in communication with the position sensor;

wherein the position sensor is configured to detect movement of the target relative to the position sensor and provide an output signal to the controller, wherein the position sensor comprises a linear array of sensors arranged, in use, along a length of the guide track in a direction of movement of the barrier, each of the sensors being configured to output a sensor signal when the target is within a detection range of the respective sensor, such that the output signal is or comprises a sequence of signal pulses;

wherein the array of sensors are part of a sensor circuit of the position sensor, the sensor circuit further comprising a control element configured to control current supplied to a group of two or more sensors in the array such that, the current supplied to each sensor in the group is repeatedly modulated between an operating current for an ON period of time and zero current for an OFF period of time, and wherein the ON period of time for each respective sensor in the group is shifted in time such that only one sensor in the group is ON at any given time; and wherein the controller is configured, in use, to:

receive the output signal from the position sensor;

determine one or more signal characteristics from the output signal; and compare the one or more determined signal characteristics with one or more predetermined signal characteristics to determine if the relative movement between the target and the position sensor is within a predefined range.

2. The device of claim 1, wherein the controller is further configured, in use, to: in response to determining the relative movement between the target and the position sensor to be outside the predefined range, send a signal to the barrier system to stop the movement of the barrier.

3. The device of claim 1, wherein the one or more signal characteristics and the one or more predetermined signal characteristics are or comprise a time interval.

4. The device of claim 1, wherein the predefined range is or comprises a time interval.

5. The device of claim 1, wherein the one or more signal characteristics and the one or more predetermined signal characteristics are or comprise a time interval between signal pulses.

6. The device of claim 1, wherein the linear array of sensors are arranged, in use, on or adjacent to the guide track at regular intervals in a direction of movement of the barrier.

7. The device of claim 1, wherein the target is a plurality of targets.

8. The device of claim 1, wherein the target is or comprises a magnet, and the position sensor is or comprises a magnetic field sensor.

9. The device of claim 1, wherein the target is or comprises a light emitting device, and the position sensor is or comprises a photodetector.

10. The device of claim 1, wherein the position sensor is housed in a sensor housing, and wherein the target is housed in a target housing.

11. A movable barrier system comprising:

a barrier movable between an open position and a closed position along a guide track; and a safety device, as defined in claim 1.

12. The device of claim 7, wherein the plurality of targets are arranged, in use, on the barrier at regular intervals in the direction of movement of the barrier.

13. The device of claim 8, wherein the magnet is a permanent magnet.

14. The device of claim 13, wherein the magnet is a two-pole magnet arranged, in use, such that the poles of the magnet are aligned perpendicular to the direction of movement of the barrier.

15. The device of claim 1, wherein the one or more signal characteristics and the one or more predetermined signal characteristics are or comprise a time interval between a signal pulse and a sequence start time.

* * * * *